US007650092B2

(12) United States Patent
Oyumi

(10) Patent No.: US 7,650,092 B2
(45) Date of Patent: Jan. 19, 2010

(54) IMAGE FORMING APPARATUS THAT UTILIZES CONVERTED DATA BASED ON TEMPERATURE DETECTION

(75) Inventor: Masashi Oyumi, Abiko (JP)

(73) Assignee: Canon Kabushiki Kaisha (JP)

( * ) Notice: Subject to any disclaimer, the term of this patent is extended or adjusted under 35 U.S.C. 154(b) by 189 days.

(21) Appl. No.: 11/860,683

(22) Filed: Sep. 25, 2007

(65) Prior Publication Data

US 2008/0075495 A1 Mar. 27, 2008

(30) Foreign Application Priority Data

Sep. 25, 2006 (JP) ..... 2006-259495

(51) Int. Cl.
*G03G 15/00* (2006.01)
*G03G 15/20* (2006.01)

(52) U.S. Cl. ..... 399/38; 399/15; 399/69

(58) Field of Classification Search ..... 399/38, 399/67, 49, 15, 69; 358/519, 521, 523
See application file for complete search history.

(56) References Cited

U.S. PATENT DOCUMENTS 5,838,465 A * 11/1998 Satou et al. ..... 358/520
6,836,626 B2 * 12/2004 Hooper et al. ..... 399/69
2007/0134011 A1 * 6/2007 Okano et al. ..... 399/45

FOREIGN PATENT DOCUMENTS

| | | | |
|---|---|---|---|
| JP | 2-40681 | A | 2/1990 |
| JP | 9-305058 | A | 11/1997 |
| JP | 2003-1876 | A | 1/2003 |
| JP | 2004-198610 | A | 7/2004 |
| JP | 2005-321672 | A | 11/2005 |

* cited by examiner

*Primary Examiner*—Sophia S Chen
(74) *Attorney, Agent, or Firm*—Rossi, Kimms & McDowell LLP

(57) ABSTRACT

In an image forming apparatus of the present invention, an allowable temperature range of a fixing unit is divided into a plurality of fixing temperature ranges, and image data conversion γ tables respectively suitable for the divided fixing temperature ranges are prepared. A fixing temperature of the fixing unit is measured during image forming. A γ table suitable for the measured fixing temperature can be selected and used. Consequently, even when a reduction in fixing temperature within the allowable temperature range is caused in the fixing unit in the case of continuously outputting color images at a high speed, the resulting change in tint of output images can be reduced.

5 Claims, 8 Drawing Sheets

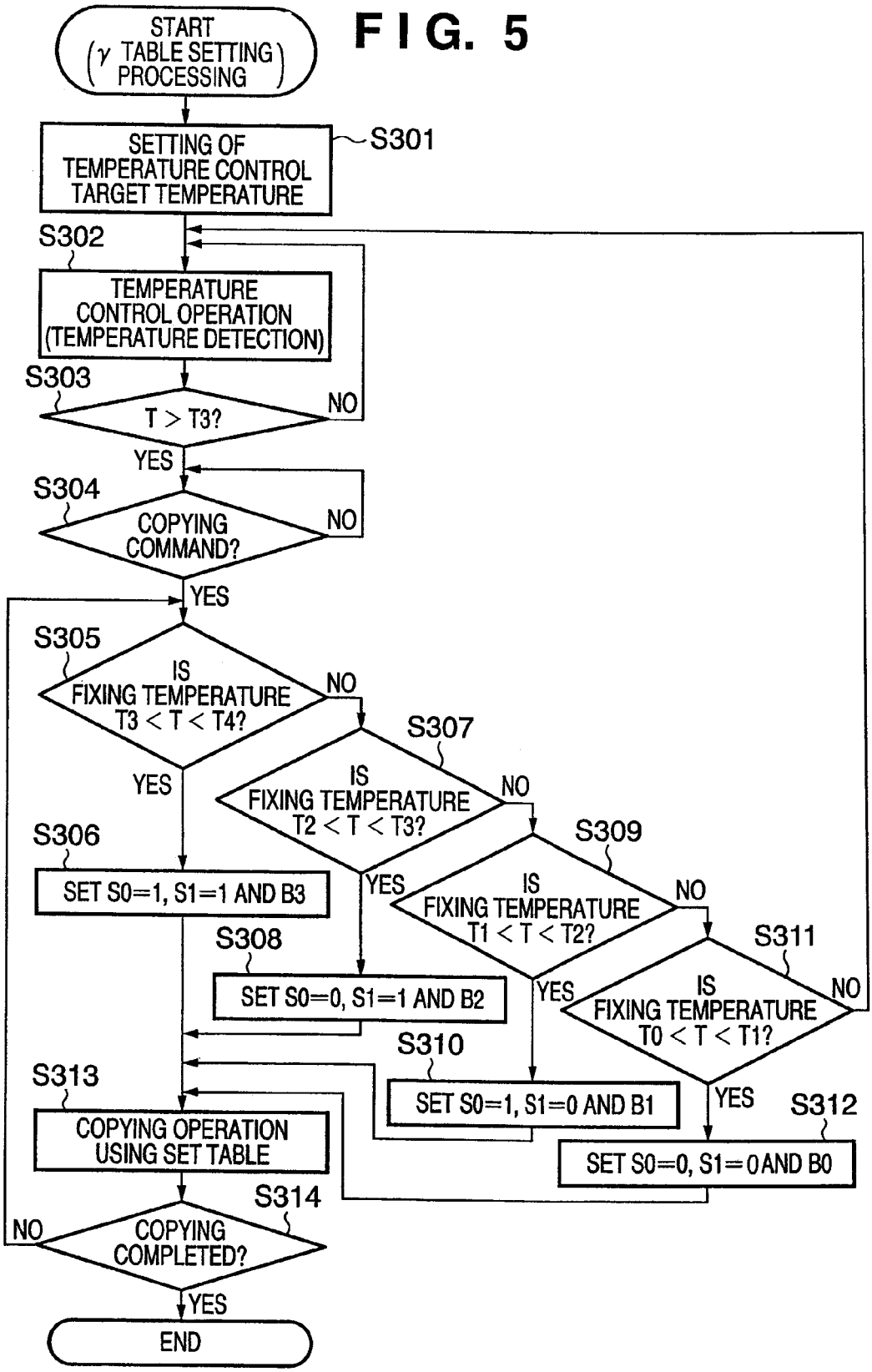
FIG. 5
START
(γ TABLE SETTING PROCESSING)
SETTING OF TEMPERATURE CONTROL TARGET TEMPERATURE
S301
S302
TEMPERATURE CONTROL OPERATION (TEMPERATURE DETECTION)
S303
T > T3?
NO
YES
S304
COPYING COMMAND?
NO
YES
S305
IS FIXING TEMPERATURE T3 < T < T4?
NO
YES
S307
IS FIXING TEMPERATURE T2 < T < T3?
NO
YES
S306
SET S0=1, S1=1 AND B3
S309
IS FIXING TEMPERATURE T1 < T < T2?
NO
YES
S308
SET S0=0, S1=1 AND B2
S311
IS FIXING TEMPERATURE T0 < T < T1?
NO
YES
S310
SET S0=1, S1=0 AND B1
S312
SET S0=0, S1=0 AND B0
S313
COPYING OPERATION USING SET TABLE
S314
COPYING COMPLETED?
NO
YES
END

IMAGE FORMING APPARATUS THAT UTILIZES CONVERTED DATA BASED ON TEMPERATURE DETECTION

BACKGROUND OF THE INVENTION

1. Field of the Invention

The present invention relates to an image forming apparatus such as a copying machine or a printer.

2. Description of the Related Art

In recent years, there has been a demand for further improving the quality of images output from color image forming apparatuses such as color copying machines. Gradation of density and the stability of density gradation in particular largely influence a person in determining the quality of an image.

Images obtained by a color image forming apparatus such as mentioned above vary in density if the environment changes or if parts of the apparatus are changed during long-time use. In particular, in the case of an electrophotographic color image forming apparatus, there is a possibility of occurrence of variation in density even with a slight environmental change and hence a possibility of color balance being lost. It is therefore necessary for the apparatus to have means for maintaining constant densities at all times.

In conventional color image forming apparatuses, therefore, measures described below have been taken. A toner image (toner patch image) for density sensing is formed by a toner in each color on an intermediate transfer member, a photosensitive member or the like, and the density of the unfixed toner patch image is sensed with an unfixed toner density sensor. Density control is performed by feeding back the result of sensing to process conditions including the amount of exposure and the development bias. Images are obtained with stability in this way.

In the above-described density control using the density sensor, a toner patch is formed on an intermediate transfer member, a drum or the like and is sensed, and no control is performed with respect to a change in color balance of the image due to transfer onto and fixation on a transfer medium performed thereafter. Therefore, the above-described density control using the unfixed toner density sensor cannot be suitably performed with respect to a change in an image transferred onto a transfer medium when the image is fixed.

A color image forming apparatus equipped with a density sensor (color sensor) for sensing the density or color of a toner patch after fixation on a transfer medium (e.g., one disclosed in Japanese Patent Laid-Open No. 9-305058) has therefore been proposed.

However, a problem described below may arise in forming an image at a high speed in a color image forming apparatus equipped with a density sensor (color sensor) for sensing the density or color of a toner patch after fixation on a transfer medium.

That is, there is an upper limit to the electric power provided in the image forming apparatus as a source of an amount of heat usable for fixation. Therefore the temperature of a fixing unit decreases during a high speed continuation of color output. In such an event, image output can be performed if the reduction in the fixing temperature of the fixing unit (from a temperature adjustment point T3 to another temperature adjustment point T0) is within an allowable temperature range such that a fixing effect high enough to prevent separation of toner can be ensured. However, even if the temperature of the fixing unit is within the allowable temperature range, a slight variation in the degree of melting of toner due to a change in fixing temperature may occur and appear as a change in tint of the resulting output image. Consequently, even at a fixing temperature within the allowable temperature range, there is a possibility of a considerable reduction in image quality due to a change in the fixing temperature.

SUMMARY OF THE INVENTION

In view of the above-described problem of the conventional art, an object of the present invention is to provide an image forming apparatus capable of reducing a change in tint of an output image due to a change in the fixing temperature of a fixing unit even when the fixing temperature is within an allowable fixing temperature range during image forming.

To achieve the above-described object, according to the present invention there is provided an image forming apparatus which comprises: conversion unit adapted to perform data conversion of image data; image forming unit adapted to form an image based on the converted image data; fixing unit adapted to fix the image formed by the image forming unit; and detection unit adapted to detect a temperature of the fixing unit. The conversion unit changes data conversion tables used at the data conversion in correspondence with the detected temperature.

The image forming apparatus further comprises: measurement unit adapted to measure an optical characteristic of a patch image fixed by the fixing unit using different fixing temperatures; preparation unit adapted to prepare the data conversion tables each corresponding to the temperature detected by the detection unit, by using the measured optical characteristic of the patch image; and storage unit adapted to store the data conversion tables prepared by the preparation unit. The measurement of the optical characteristic of the patch image by the measurement unit is executed at a startup time.

The image forming apparatus further comprises: operation history storage unit adapted to store an operation history of the image forming apparatus; and first control unit adapted to perform control based on the operation history as to whether or not the optical characteristic of the patch image is to be measured by the measurement unit.

The image forming apparatus further comprises: time lapse history storage unit adapted to store a time lapse history of the image forming apparatus; and first control unit adapted to perform control based on the time lapse history as to whether or not the optical characteristic of the patch image is to be measured by the measurement unit.

The image forming apparatus further comprises instruction unit adapted to instruct to execute measurement of the optical characteristic of the patch image by the measurement unit.

The present invention makes it possible to provide an image forming apparatus capable of reducing a change in tint of an output image due to a change in the fixing temperature of a fixing unit even when the fixing temperature is within an allowable fixing temperature range during image forming. That is, in the image forming apparatus of the present invention, the fixing temperature range is divided into a plurality of temperature ranges; data conversion tables respectively suitable for the fixing temperature ranges are held; a fixing temperature is measured during image forming; and a data conversion table suitable for the fixing temperature can be selected and used. When a reduction in fixing temperature in the allowable fixing temperature range is detected during image forming, a data conversion table suitable for the fixing temperature can be selected to be used for image forming, thus preventing the occurrence of a change in tint of images.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 5 is a flowchart for explaining image forming processing accompanied by change of γ tables based on the fixing temperature during image forming;

DESCRIPTION OF THE EMBODIMENTS

First Embodiment

Figure 1A:
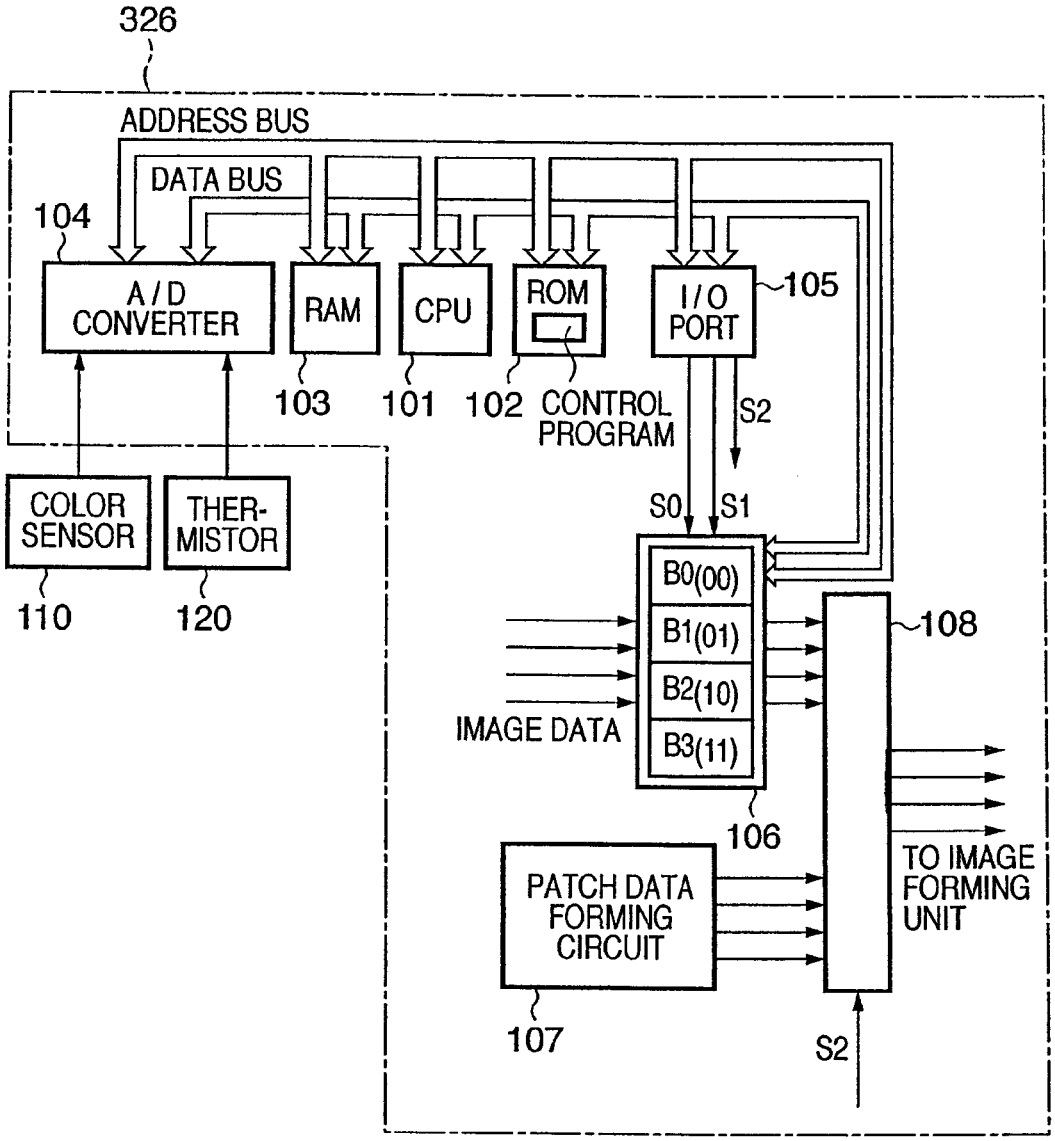
FIG. 1A is a block diagram for explaining a control configuration for selecting γ tables suitable for fixing temperatures of a printer control unit.

In an image forming apparatus of the present invention, an allowable temperature range of a fixing unit is divided into a plurality of fixing temperature ranges (A0, A1, A2, A3, . . . ) and γ tables (γ0, γ1, γ2, γ3, . . . ) for image data conversion suitable for the divided fixing temperature ranges (A0, A1, A2, A3, . . . ) are prepared. For example, in a case where the allowable temperature range is divided into four as shown in FIG. 1A, γ0, γ1, γ2, and γ3 are stored in bank regions B0, B1, B2, and B3 of a γ table 106 of a printer control unit 326. At the time of image forming, the fixing temperature of the fixing unit is measured and the γ table suitable for the fixing temperature is selected and used. Therefore, even when the temperature of the fixing unit is reduced in the allowable temperature range in the case of continuously outputting color images at a high speed, the image forming apparatus can reduce a change in tint of an output image due to a variation in the degree of melting of toner caused by the change in fixing temperature.

Figure 4:
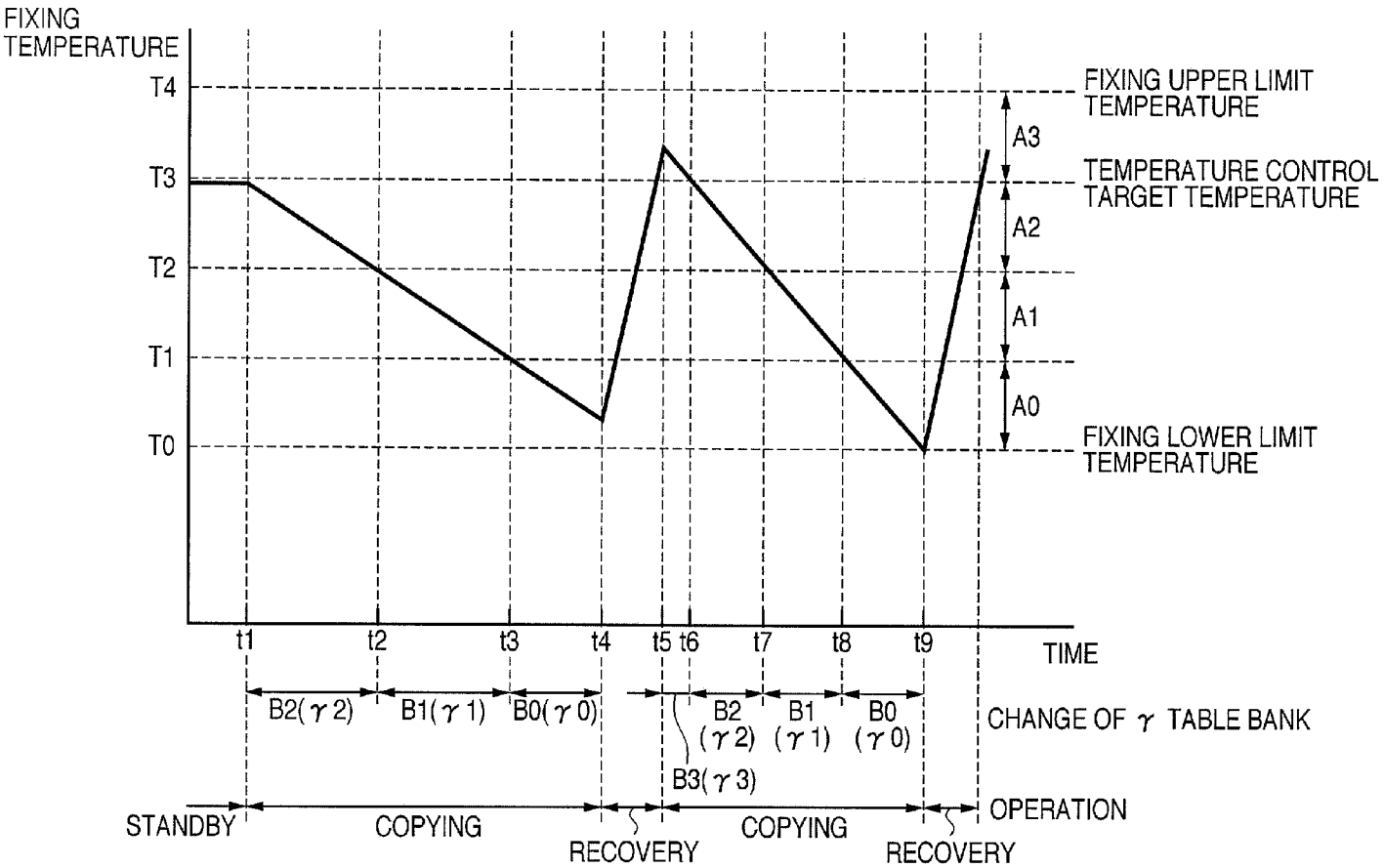
FIG. 4 is a diagram for explaining the relationship between fixing temperatures detected during image forming and γ tables (γ0, γ1, γ2, and γ3) used in detected fixing temperature ranges (A0, A1, A2, and A3)

(Example of Division of the Fixing Temperature Range: FIG. 4)

The relationship between fixing temperatures detected at the time of image forming and γ tables used in correspondence with detected fixing temperature ranges will be described with reference to FIG. 4.

The allowable temperature range of the fixing unit is equally divided into four fixing temperature ranges (A0, A1, A2, A3) T0 represents an allowable lower limit temperature (hereinafter referred to as fixing lower limit temperature) of the fixing unit; T3 a target temperature set in temperature control (hereinafter referred to as temperature control target temperature); and T4 an allowable upper limit temperature (hereinafter referred to as fixing upper limit temperature) of the fixing unit. A0 represents a temperature range expressed by $T0 \leqq T \leqq T1$; A1 a temperature range expressed by $T1 < T \leqq T2$; A2 a temperature range expressed by $T2 < T \leqq T3$; and A3 a temperature range expressed by $T3 < T \leqq T4$. Also, γ tables (γ0, γ1, γ2, and γ3) for image data conversion respectively suitable for the fixing temperature ranges (A0, A1, A2, and A3) are prepared. The fixing temperature of a fixing device is measured at the time of image forming. If the measured fixing temperature range is A0 ($T0 \leqq T \leqq T1$), the γ0 table is selected as an image data conversion γ table to be used for conversion of image data. Similarly, if the measured fixing temperature range is A1, A2 or A3, the γ1, γ2 or γ3 table is selected. As a result, data conversion of image data is performed by using as a γ table suitable for the measured fixing temperature the γ0, γ1, γ2 or γ3 table corrected with respect to a change in fixing temperature. A problem due to a change in image tint due to a change in fixing temperature is solved in this way.

(Control Configuration for Selecting the γ Table with Respect to the Fixing Temperature: FIG. 1A)

An example of a control configuration for selecting the γ table, which is a feature of the image forming apparatus mentioned above, suitable for the fixing temperature of the fixing unit detected on the basis of the result of detection of the fixing temperature of the fixing unit will be described with reference to the block diagram of FIG. 1A.

The area of the γ table 106 of the printer control unit 326 shown in FIG. 1A is divided into four banks B0, B1, B2, and B3, and γ tables (γ0, γ1, γ2, and γ3) suitable for the four divided fixing temperature ranges of the fixing unit are prepared in the divided banks. The printer control unit 326 performs control to select, from the prepared γ tables, the γ table suitable for the detected fixing temperature of the fixing unit on the basis of the result of detection of the temperature of the fixing unit.

Referring to FIG. 1A, the printer control unit 326 is constituted by an A/D converter 104, a RAM 103, a CPU 101, a ROM 102, an I/O port 105, the γ table 106, a patch data forming circuit 107, and a selector 108. A signal from a color sensor 110 and a signal from a thermistor 120 for sensing the temperature of the fixing unit are input to the printer control unit 326. The color sensor 110 will be described below in detail with reference to FIGS. 2 and 3.

The CPU 101 is a central processing unit for performing sequential control in the image forming apparatus. In the ROM 102 are stored various control programs described below with respect to control processing for selecting from the γ tables, γ table preparation processing and so on. The RAM 103 is used as a work area by the CPU 101 when the CPU 101 executes the control programs to control the units.

Referring to FIG. 1A, an analog value is converted into a digital value in the A/D converter 104, and signals S0, S1, and S2 for selection from the γ tables and on/off control of loads are output from the I/O portion 105 according to instructions from the CPU 101. The γ table 106 changes the banks for the image data conversion tables on the basis of the signals S0 and S1 from the I/O port 105. The patch data forming circuit 107 forms patch data. The selector 108 changes output signals on the basis of the signal S2 from the I/O port 105. Values from the γ table 106 can be rewritten on the basis of the color sensor 110 through an address bus and a data bus connected to the CPU 101.

In the example of the γ table 106 shown in FIG. 1A, the γ table is divided into the four banks B0, B1, B2, and B3 in correspondence with the four fixing temperature ranges (A0, A1, A2, and A3 shown in FIG. 4) equally divided from the allowable temperature region of the fixing portion. Conversion tables for colors MYCK are formed in the divided banks. Selection from the conversion tables is made on the basis of the signal from the I/O port 105, thus performing Bank change between the conversion tables to be applied to image data. The γ table (γ0) in the bank B0 corresponds to the fixing temperatures T0 to T1; the γ table (γ1) in the bank B1, the fixing temperatures T1 to T2; the γ table (γ2) in the bank B2, the fixing temperatures T2 to T3; and the γ table (γ3) in the bank B3, the fixing temperatures T3 to T4. In the γ table 106, a selection from the γ tables (γ0, γ1, γ2, and γ3) to be respectively used in the fixing temperature ranges is made by using as addresses the signal (S0 and S1) input on the basis of the measured fixing temperature, and data image conversion is performed by using the selected γ table. That is, image data conversion is performed by using the γ table (γ0) selected by the signal (00) designating B0 if the measured fixing temperature is A0, by using the γ table (γ1) selected by the signal (01) designating B1 if the measured fixing temperature is A1, by using the γ table (γ2) selected by the signal (10) designating B2 if the measured fixing temperature is A2, or by using the γ table (γ3) selected by the signal (11) designating B3 if the measured fixing temperature is A3.

The γ table 106 and patch data formed by the patch data forming circuit 107 are respectively input to the selector 108. Either of the γ table 106 and the patch data is selected on the basis of the signal S2 from the I/O port 105 to be output to an image forming unit described below. The image forming unit forms an image on the basis of data selected by the selector 108.

Figure 1B:
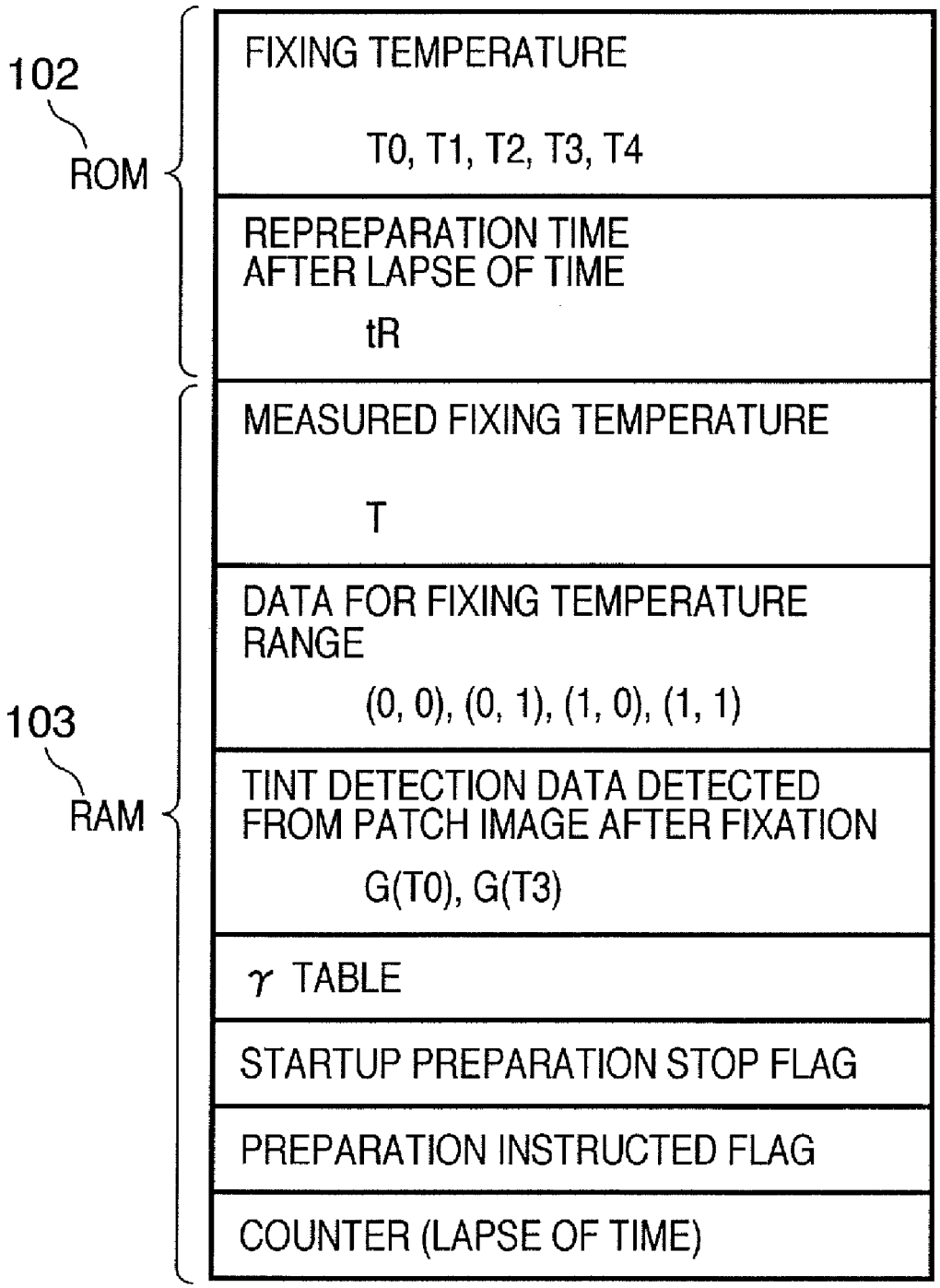
FIG. 1B is a diagram showing an example of data stored in a ROM and a RAM.

(Example of the Memory Configuration of the Image Forming Apparatus: FIG. 1B)

FIG. 1B shows an example of data stored in the ROM 102 and the RAM 103.

For example, set fixing temperatures T0, T1, T2, T3, and T4, and a repreparation time tR after a lapse of time are stored in the ROM 102. T0 is a fixing lower limit temperature, T3 a temperature control target temperature, and T4 a fixing upper limit temperature. The repreparation time tR after a lapse of time is used for an instruction to detect a tint when the lapse of time after a startup of the image forming apparatus exceeds tR. In the RAM 103 are stored, for example, a measured fixing temperature T, data for fixing temperature ranges, tint detection data G (T0), G (T3) of patch images after fixation at fixing temperatures T0, T3, a γ table obtained by interpolation calculation based on the G (T0), G (T3), flags for operator instructions (including an instruction to stop preparation with respect to tint detection at the time of startup, and an instruction to perform preparation with respect to tint detection at a designated time) and a time lapse counter value.

Figure 2:
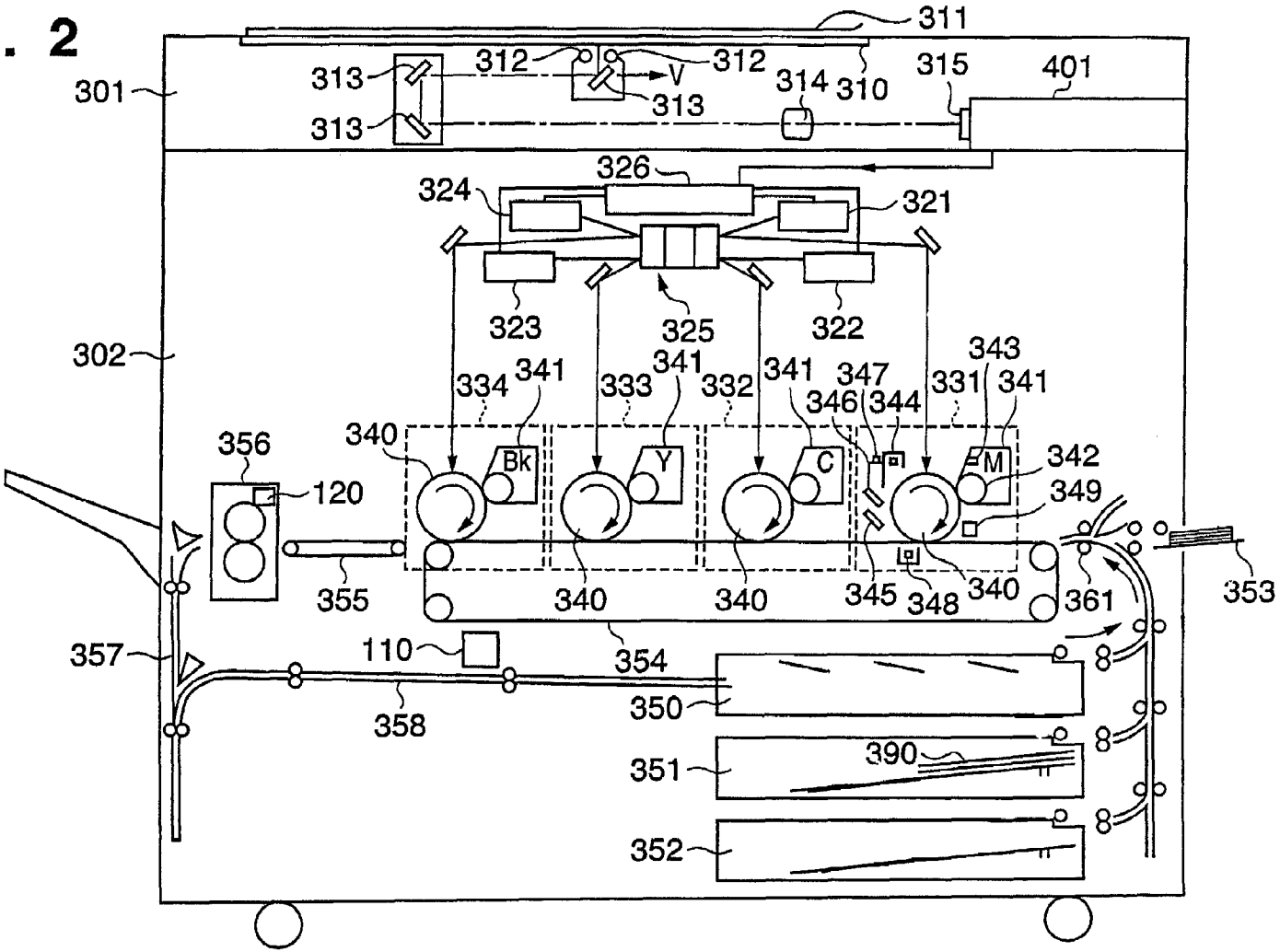
FIG. 2 is a diagram showing the entire configuration of the image forming apparatus of the present invention.

(Entire Configuration of the Image Forming Apparatus: FIG. 2)

The entire configuration of the image forming apparatus of the present invention will now be described with reference to FIG. 2.

The image forming apparatus of the present invention is constituted by a reader unit 301 and a printer unit 302. An original placed between an original table 310 and an original pressing plate 311 is scanned in the direction of arrow V with light from a lamp 312. Reflected light image from the original is formed on a CCD 315 with a three-color RGB filter through a group of mirrors 313 and a lens 314 and is photoelectrically converted into signals for RGB colors by the CCD 315. The converted image signals in electrical form undergo predetermined image processing in an image processing unit 401 to form CMYK output image data. This data is sent to the printer unit 302.

Reference numeral 326 denotes a printer control unit which performs image control and drive control. Reference numeral 325 denotes a polygon scanner for scanning surfaces of a photosensitive drums with laser light. Reference numeral 331 denotes an image forming unit for forming a magenta (M) image in an initial stage. Reference numerals 332, 333, 334 respectively denote image forming units for forming images in cyan (C), yellow (Y) and black (K).

In the printer control unit 326, image conversion processing for predetermined γ correction is performed on image data. The surfaces of the photosensitive drums are scanned with laser beams from laser elements 312 to 324 independently driven according to the γ corrected image data. Reference numeral 340 denotes each photosensitive drum in the image forming unit 331 for forming a latent image by exposure with laser light. Reference numeral 341 denotes a development devices for performing toner development on each drum 340. Reference numeral 342 denotes a sleeve for performing toner development by applying a development bias in the development device 341. Reference numeral 343 denotes a developer density sensor for detecting the density of a developer on the development sleeve from the amount of light reflected from the developer. Reference numeral 344 denotes a primary charger for charging the photosensitive drum 340 to a desired voltage. Reference numeral 345 denotes a cleaner for cleaning the surface of the drum 340 after transfer. Reference numeral 346 denotes an auxiliary charger for discharging the surface of the drum 340 cleaned by the cleaner 345 to enable the primary charger 344 to have good charging performance. Reference numeral 347 denotes a pre-exposure lamp for eliminating residual charge on the drum 340. Reference numeral 348 denotes a transfer charger for transferring a toner image from the drum 340 onto a transfer member by performing charging from an inner portion of a transfer belt 354. Reference numeral 349 denotes a developer density sensor for detecting the amount of light reflected from developed toner image formed on the photosensitive drum 340.

A transfer medium such as a paper sheet is fed and transported from a sheet feeder 351 or 352, a sheet refeeder 350 or a manual feeder 353. Reference numeral 361 denotes a registration roller which temporarily stops the recording medium to determine timing of transport of the transfer medium to the image forming unit. After timing with the registration roller, the transfer medium is transported onto the transfer belt 354. The toner image formed on the photosensitive drum is transferred onto the transfer medium transported by the transfer belt, thereby forming a magenta image on the transfer medium. This electrophotographic process is performed in the same manner in each of the development stations to form a cyan, yellow or black image, thus forming a color image on the transfer medium in correspondence with the original. The image formation medium passes through a fixation pre-transfer path 355, and the toner image is heat-fixed on the transfer medium by a fixing device 356. The transfer medium having the image fixed thereon is then output. The fixing device 356 is temperature-controlled by sensing the temperature of a fixing member with the thermistor 120 in contact with the fixing member and performing temperature control on the basis of the sensed temperature. If reverse-side sheet discharge of the sheet is performed by positioning the image surface on the reverse side, the recording medium is transported into a reversing transport path 357, reversed in the reversing transport path, and discharged thereafter. In a mode for forming images on the both surfaces, the fixed image formation medium is transported from the reversing transport path 357 into a sheet refeed path 358, fed into the sheet refeeder 350, and placed as medium for second-surface image formation. Reference numeral 110 denotes a color sensor placed on the sheet refeed path 358 to measure an optical characteristic of the patch image.

In the image forming apparatus, an operating unit (not shown) enables instruction from an operator to the apparatus and instruction from the apparatus to the operator (e.g., instruction not to perform processing for automatically obtaining γ data at the time of powering-on).

Figure 3:
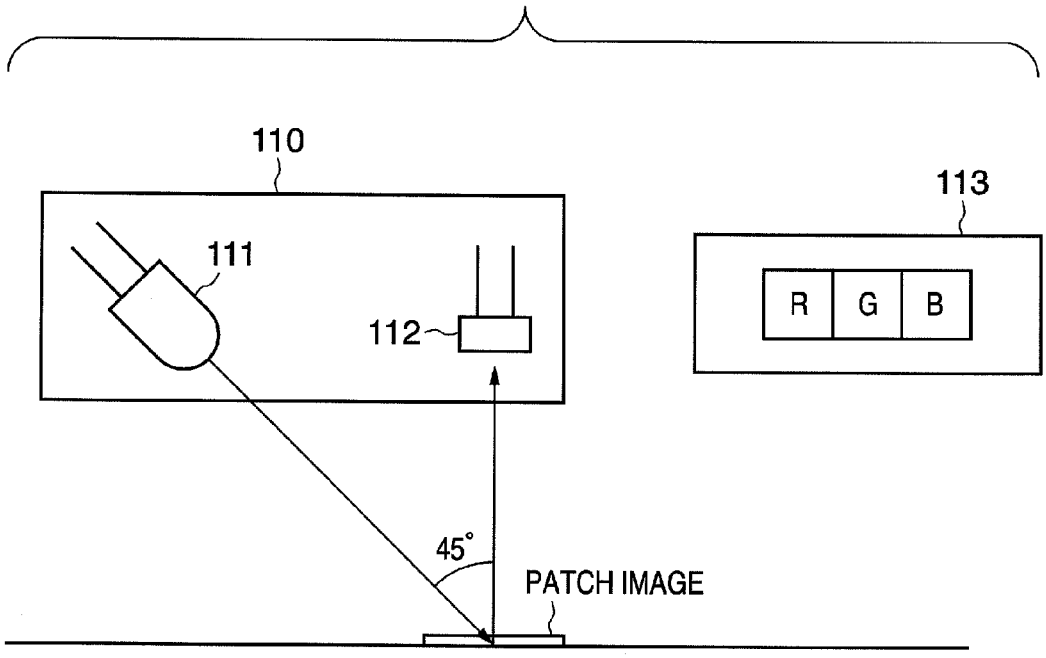
FIG. 3 is a diagram for explaining an example of the configuration of a color sensor.

(Configuration of Color Sensor 110: FIG. 3)

The above-described color sensor 110 will be described. FIG. 3 shows an example of the configuration of the color sensor 110.

The color sensor 110 is constituted by a white LED 111 and a charge-storage-type sensor 112 with an RGB on-chip filter. Light from the white LED 111 is incident at an angle of 45 degrees on the transfer medium having the patch image formed thereon after fixation, and the intensity of diffused reflection in the 0-degree direction is sensed with the charge-storage-type sensor 112 with an RGB on-chip filter. A light receiving portion 113 of the charge-storage-type sensor 112 with an RGB on-chip filter has RGB sensing elements independent of each other. The values of the results of sensing with the charge-storage-type sensor 112 with an RGB on-chip filter are converted from analog form into digital values to be used for control.

The above-described charge-storage-type sensor 112 with an RGB on-chip filter may be photodiodes or an array of several groups of sensing elements each consisting of three R, G and B elements. The arrangement of the charge-storage-type sensor 112 with an RGB on-chip filter may alternatively be such that the incident angle is 0 degree while the reflection angle is 45 degrees. Further, a sensor having no filter, capable of emitting light in three R, G and B colors and used in combination with LED filters may constitute the color sensor 110 instead of the charge-storage-type sensor 112 with an RGB on-chip filter.

The tint sensing operation with the color sensor 110 will be described. As image data, patch data corresponding to a predetermined size and density is generated by the patch data forming circuit 107 in the printer control unit 326. Patch image formation is performed on the basis of the patch data in the same manner as ordinary images. The transfer medium having the patch image heat-fixed thereon by the fixing device 356 is transported from the reversing transport path 357 to the sheet refeed path 358. The transfer medium is stopped at a position such as to face the color sensor 110, and predetermined patch image tint detection is performed with the color sensor 110. After patch image tint detection, the transfer medium is again fed into the sheet refeeder 350 and again transported to the image forming transport path to be discharged out of the apparatus.

(Example of Changing the Fixing Temperature and the γ Table: FIG. 4)

FIG. 4 is a diagram showing an example of changing the γ table according to the measured fixing temperature T of the fixing unit.

Copying is started at the fixing temperature T3 at time t1. At this time, image forming is performed by using γ2 as the γ table if the fixing temperature is in the fixing temperature range A2 (T2<T≦T3) shown with a time from t1 to t2. When the fixing temperature is reduced to be in the fixing temperature range A1 (T1<T≦T2) with continuous progress in copying as indicated with a time from t2 to t3, image forming is performed by changing the γ table from γ2 to γ1. When the fixing temperature is reduced to be in the fixing temperature range A0 (T0≦T≦T1) with further continuous progress in copying as indicated with a time from t3 to t4, image forming is performed by changing the γ table from γ1 to γ0. Recovery of the fixing temperature of the fixing unit is performed as shown with a time from t4 to t5 to adjust the fixing temperature of the fixing unit to a point higher than T3. Copying is thereafter performed during a time from t5 to t9, as shown in the diagram. During this time, image forming is performed by using γ3 as the γ table if the fixing temperature is in the fixing temperature range A3 (T3<T≦T4) shown with a time from t5 to t6. Also, γ2 is used as the γ table at times t6 to t7, γ1 is used as the γ table at times t7 to t8, and γ0 is used as the γ table at times t8 to t9. After the completion of copying, a standby operation is performed by setting the fixing temperature T of the fixing unit to T=T3.

(Image Forming Processing in which the γ Table is Changed on the Basis of the Fixing Temperature: FIG. 5)

Image forming processing accompanied by change of the γ table based on the fixing temperature during image forming described with reference to FIG. 1A will be described with reference to FIG. 5.

Referring to FIG. 5, in step S301 after starting image forming processing, the temperature control target temperature Tc of the fixing unit is set to Tc=T3. Next, in step S302, an operation to control the temperature of the fixing unit and detection of the fixing temperature of the fixing unit are performed.

In step S303, if the detected fixing temperature T is lower than T3, the apparatus is on standby while performing the fixing unit temperature control operation until the detected fixing temperature T becomes equal to T3. If the detected fixing temperature T is equal to or higher than T3 in step S303, the process advances to step S304.

In step S304, copying operation acceptance is performed. When a command to perform a copying operation is given, the process advances to step S305. In step S305, the detected fixing temperature T is checked. If T3<T<T4, the process advances to step S306 to issue signal S0=1, signal S1=1 and set bank B3 (γ table=γ3). The process then advances to step S313.

If T3<T<T4 is not satisfied in step S305, the process advances to step S307. If T2<T<T3, the process advances to step S308 to issue signal S0=0, signal S1=1 and set bank B2 (γ table=γ2) The process then advances to step S313.

If T2<T<T3 is not satisfied in step S307, the process advances to step S309. If T1<T<T2, the process advances to step S310 to issue signal S0=1, signal S1=0 and set bank B1 (γ table=γ1). The process then advances to step S313.

If T1<T<T2 is not satisfied in step S309, the process advances to step S311. If T0<T<T1, the process advances to step S312 to issue signal S0=0, signal S1=0 and set bank B0 (γ table=γ0) The process then advances to step S313.

In step S313, a copying operation is performed by using the γ table in the set bank B3, B2, B1 or B0. Next, in step S314, if copying is not completed, the copying operation is repeated by the above-described processing from step S305 to S313 while detecting the temperature of the fixing unit, thus performing image forming processing. If the detected fixing temperature T decreases during continuation of the copying operation, and if the detected fixing temperature T is T<T0 in step S311, the copying operation is temporarily stopped. The temperature control operation is performed until T>T3 is satisfied (steps S302 and S303). Image forming processing can be performed by performing the above-described processing.

In the image forming apparatus, as described above, the temperature of the fixing unit is measured and the γ table suitable for the fixing temperature is selected and used during image forming. In the image forming apparatus, therefore, a change in tint of an output image due to variation in the degree of melting of toner caused by a change in the fixing temperature can be reduced even in a situation where the temperature of the fixing unit is reduced in the allowable temperature range during high-speed continuous output of color images.

Figure 6:
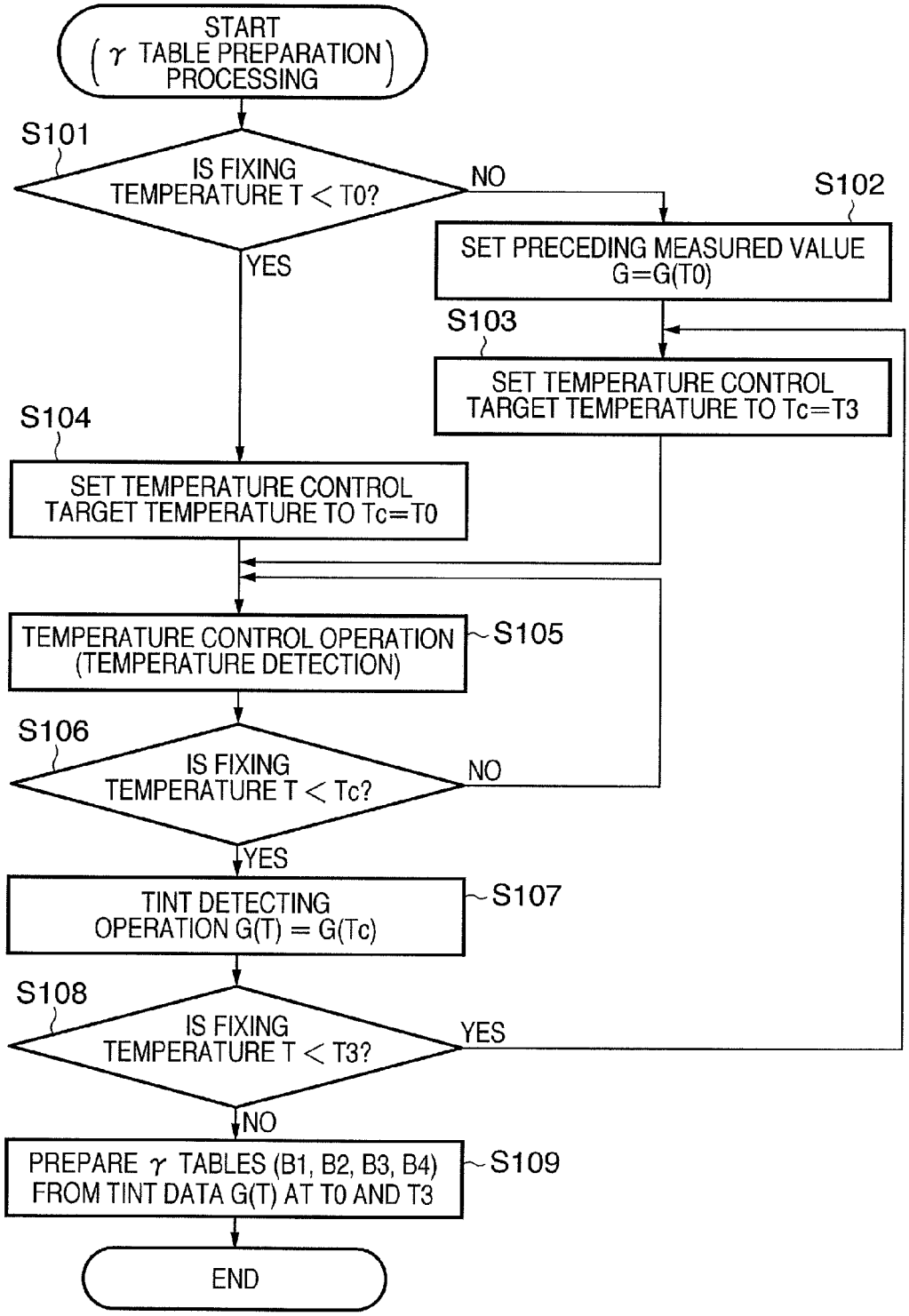
FIG. 6 is a flowchart for explaining processing for forming γ tables (γ0, γ1, γ2, and γ3) suitable for the fixing temperature ranges (A0, A1, A2, and A3)

(γ Table Forming Processing: FIG. 6)

Processing for forming γ tables (γ0, γ1, γ2, and γ3) respectively suitable for the four fixing temperature ranges (A0, A1, A2, and A3) used in the process shown in FIG. 5 will be described with reference to FIG. 6.

FIG. 6 is a flowchart showing an example of processing for forming γ tables (γ0, γ1, γ2, and γ3) respectively suitable for the four fixing temperature ranges (A0, A1, A2, and A3) automatically performed after powering-on.

Referring to FIG. 6, in step S101 after starting γ table-forming processing, the fixing temperature T is detected. If the detected fixing temperature T is T<T0, the process advances to step S104 and the temperature control target temperature Tc is set to Tc=T0. The process then advances to step S105 to perform a tint detecting operation G (T) described below. If the fixing temperature T detected in step S101 is T≧T0, the process advances to step S102 the preceding tint detection result G (T0) stored on a nonvolatile memory is set without performing the tint detecting operation G (T0) with respect to T=T0.

In step S105, the fixing unit temperature control operation is performed and the fixing temperature T is detected. Subsequently, in step S106, the apparatus is on standby until the detected fixing temperature T becomes equal to Tc=T0. When Tc=T0 is reached, the process advances to step S107.

In step S107, the tint detecting operation G (T)=G (T0) at the fixing temperature T0 of the fixing unit is performed. That is, the patch image is formed on the transfer medium by the patch data forming circuit 107, the developer image is heat-fixed at the fixing temperature T0 in the fixing unit and the tint of the fixed patch image is detected with the color sensor 110.

In step S108, the detected fixing temperature T is checked. If T<T3, the process advances to step S103 and the temperature control target temperature Tc is set to Tc=T3. The process then advances to step S105.

In step S105, the fixing unit temperature control operation is performed and the fixing temperature T is detected. Subsequently, in step S106, the apparatus is on standby until the detected fixing temperature T becomes equal to Tc=T3. When Tc=T3 is reached, the process advances to step S107.

In step S107, the tint detecting operation G (T)=G (T3) at the fixing temperature T3 of the fixing unit is performed. That is, the patch image is formed on the transfer medium by the patch data forming circuit 107, the developer image is heat-fixed at the fixing temperature T3 in the fixing unit and the tint of the fixed patch image is detected with the color sensor 110.

Next, the process advances from step S108 to step S109 and γ tables to be used in the four fixing temperature ranges (A0, A1, A2, and A3) are computed on the basis of the values of tint data G (T0) and G (T3) measured by the tint detecting operation at T0 and T3. A0 is T0≦T≦T1; A1 is T1<T≦T2; A2 is T2<T≦T3; and A3 is T3<T≦T4. In this step, for example, four γ tables (γ0, γ1, γ2 and γ3) corresponding to the fixing temperatures T0, T1, T2, T3, and T4 are prepared by interpolation calculation on the basis of tint data G (T0) and G (T3) at fixing temperatures T0 and T3. The prepared γ0 is used in the range A0 (T0≦T≦T1); γ1, in the range A1 (T1<T≦T2); γ2, in the range A2 (T2<T≦T3); and γ3, in the range A3 (T3<T≦T4). The prepared γ tables are respectively stored in B0, B1, B2, and B3 of the γ table 106 shown in FIG. 1A.

The above-described arrangement and operation in the image forming apparatus enable correction of a change in tint based on a change in fixing temperature even in the allowable range of the fixing temperature. Therefore, data conversion of image data can be performed by using γ tables corrected with respect to a change in the fixing temperature even in the allowable range of the fixing temperature, in contrast with the conventional art based on use of one γ table in the allowable range of the fixing temperature. Consequently, a change in tint of an image due to a reduction in fixing temperature during image forming can be reduced.

The embodiment has been described with respect to an example of image data conversion by dividing a fixing temperature range corresponding to a γ table into four and changing four prepared γ tables. However, the number of divisions is not limited to this. Also, control may be performed in such a manner that γ tables in two banks are provided; one of the two banks is used for image conversion; data computed in real time on the basis of a temperature detection result is written to the other bank; and the banks are changed on an image-to-image basis. While the description has been made by assuming use of the mode in which tint detection is automatically performed after powering-on, the arrangement of the present embodiment may also be such that command setting for changing the setting as to whether or not this tint detecting operation will be executed is performed from an operating unit not shown. Further, the arrangement may comprise first and third control unit for performing control so that the tint detecting operation is performed on the basis of values in an operation counter (operation history storage unit) for counting operations in terms of number of sheets in an operation history of the apparatus and a time lapse counter (time storage unit) for counting times in a time lapse history.

Second Embodiment

An image forming apparatus in a second embodiment of the present invention will be described. The image forming apparatus in the second embodiment is similar to the image forming apparatus in the first embodiment. A redundant description for sections common to the image forming apparatus in the second embodiment and the image forming apparatus in the first embodiment is omitted in the following description. The following description is made only of different points.

In the image forming apparatus in the first embodiment, processing for forming γ tables (γ0, γ1, γ2 and γ3) respectively suitable for the divided fixing temperature ranges (A0, A1, A2, and A3) of the fixing unit is performed after powering-on. The image forming apparatus of the second embodiment differs from that in the first embodiment in that γ table forming processing is performed by performing the tint detection operation on the basis of a command from an operator to perform when the command is input by the operator. Accordingly, the processing described with respect to the image forming apparatus in the first embodiment with reference to FIG. 1 to FIG. 5 are common to the apparatuses in the first and second embodiments. Therefore the description for them will not be repeated. Processing for forming γ tables performed on the basis of a command from an operator when the command is input by the operator will be described.

Figure 7:
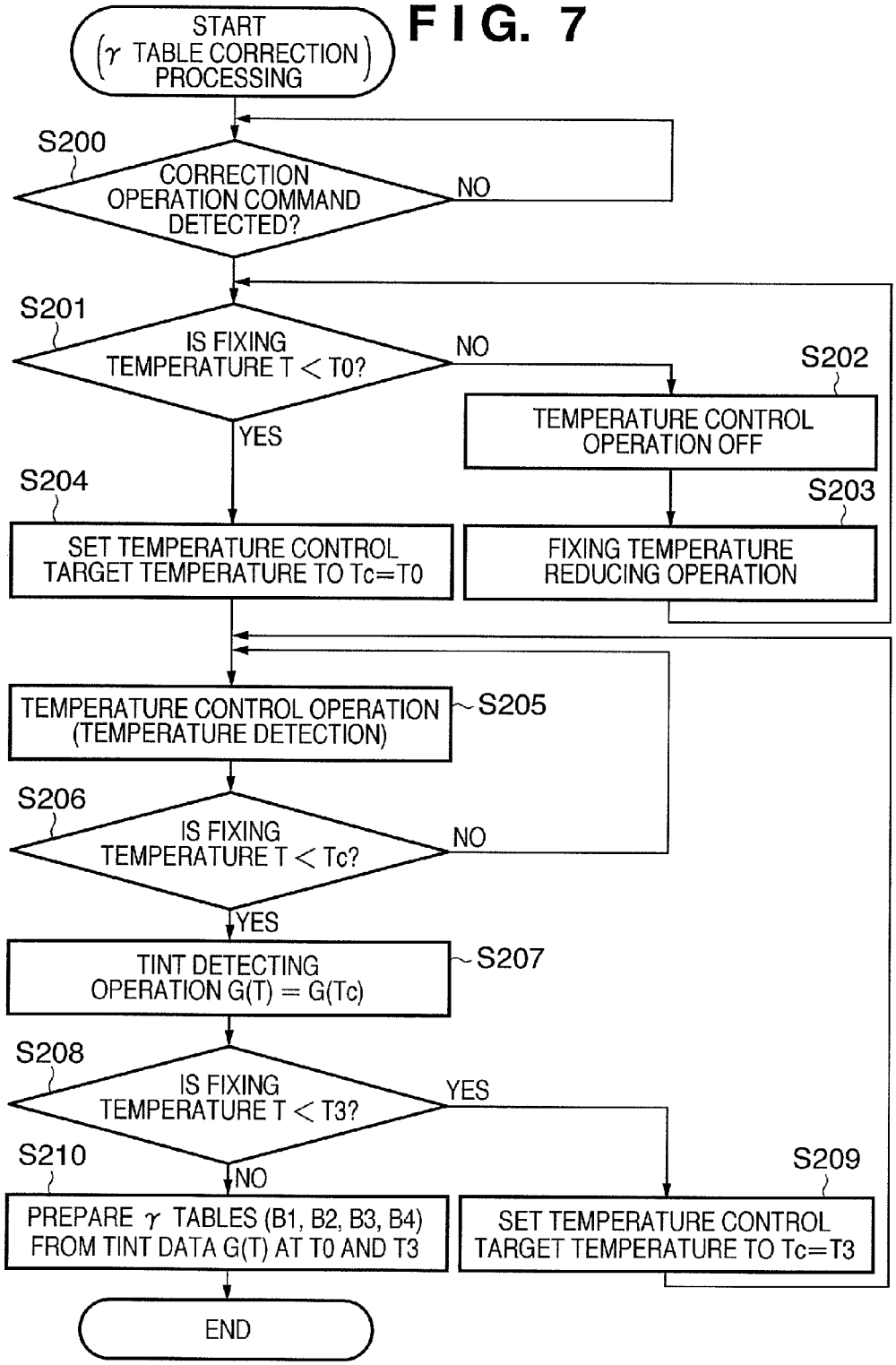
FIG. 7 is a flowchart showing an example of processing for generating γ tables according to a command from an operator.

(γ Table Forming Processing Based on Command From Operator: FIG. 7)

FIG. 7 is a flowchart showing an example of processing (γ table correcting processing) for forming γ tables performed on the basis of a command from an operator when the command is input by the operator. Processing shown in FIG. 7 is processing for performing the tint detection operation on the basis of a command from an operator when the operator inputs from an operating unit not shown a command to perform γ table forming processing, for example, after the image forming apparatus has entered a standby state.

In step S200 shown in FIG. 7, the CPU 101 detects the γ table forming processing command from the operator (see a preparation command flag shown in FIG. 1B) and advances the process to step S201.

In step S201, the CPU 101 advances the process to step S202 if the fixing temperature T detected with the thermistor 120 (see the measured fixing temperature T in FIG. 1B) satisfies T>T0. In step S202, the temperature control operation for adjustment to the set temperature is stopped to reduce the fixing temperature of the fixing unit. Next, in step S203, the reduction in the fixing temperature of the fixing unit is promoted by performing a temperature reducing operation, i.e., an operation to successively feed transfer medium sheets having no toner images formed thereon into the fixing unit. The temperature reducing operation may alternatively be such that sheet feeding of one sheet is cyclically performed instead of successively feeding a plurality of sheets, or the temperature control operation for the fixing unit is stopped and a reduction in temperature is awaited without performing any particular operation. This processing in steps S202 and S203 corresponds to the cooling unit.

In step S202, if the fixing temperature T is reduced so as to satisfy T<T0, the process advances to step S204.

In step S204, temperature control target temperature Tc=T0 is set. Subsequently, in step S205, the temperature control operation is restarted and the fixing temperature T is detected. In step S206, the apparatus is on standby until the detected fixing temperature becomes equal to Tc=T0. When the fixing temperature T becomes equal to Tc=T0, the process advances to step S207.

In step S207, the tint detecting operation G (T)=G (T0) at the fixing temperature T0 of the fixing unit is performed. That is, the patch image is formed on the transfer medium by the patch data forming circuit 107, the developer image is heat-fixed at the fixing temperature T0 in the fixing unit and the tint of the fixed patch image is detected with the color sensor 110.

In step S208, the detected fixing temperature T is checked. If T<T3, the process advances to step S209 and the temperature control target temperature Tc is set to Tc=T3. The process then advances to step S205.

In step S205, the fixing unit temperature control operation is performed and the fixing temperature T is detected. Subsequently, in step S206, the apparatus is on standby until the detected fixing temperature T becomes equal to Tc=T3. When Tc=T3 is reached, the process advances to step S207.

In step S207, the tint detecting operation G (T)=G (T3) at the fixing temperature T3 of the fixing unit is performed. That is, the patch image is formed on the transfer medium by the patch data forming circuit 107, the developer image is heat-fixed at the fixing temperature T3 in the fixing unit and the tint of the fixed patch image is detected with the color sensor 110.

Next, the process advances from step S208 to step S210 and γ tables to be used in the four fixing temperature ranges (A0, A1, A2, and A3) are computed on the basis of the values of tint data G (T0) and G (T3) measured by the tint detecting operation at T0 and T3. A0 is T0≦T≦T1; A1 is T1<T≦T2; A2 is T2<T≦T3; and A3 is T3<T≦T4. In this step, for example, four γ tables (γ0, γ1, γ2 and γ3) corresponding to the fixing temperatures T0, T1, T2, T3, and T4 are prepared by interpolation calculation on the basis of tint data G (T0) and G (T3) at fixing temperatures T0 and T3. The prepared γ0 is used in the range A0 (T0≦T≦T1); γ1, in the range A1 (T1<T≦T2); γ2, in the range A2 (T2<T≦T3); and γ3, in the range A3 (T3<T≦T4).

The above-described arrangement and operation in the image forming apparatus enable correction of a change in tint based on a change in fixing temperature even in the allowable range of the fixing temperature. Therefore, data conversion of image data can be performed by using γ tables corrected with respect to a change in the fixing temperature even in the allowable range of the fixing temperature, in contrast with the conventional art based on use of one γ table in the allowable range of the fixing temperature. Consequently, a change in tint of an image due to a reduction in fixing temperature during image forming can be reduced.

Other Embodiments

According to the object of the present invention, a storage medium on which the program code of a piece of software for realizing the functions of each of the embodiments is stored may be supplied to a system or an apparatus. In such a case, the system or a computer in the apparatus (a CPU, an MPU or the like) may read out and execute the program code stored on the storage medium to achieve the object.

In such a case, the program code itself, read out from the storage medium, realizes the above-described functions of the embodiments, and the program code and the storage medium having the program code stored thereon constitute the present invention.

As the storage medium for supplying the program code, a floppy disk, a hard disk, a magneto-optical disk, a CD-ROM, a CD-R, or a CD-RW for example may be used. A DVD-ROM, a DVD-RAM, a DVD-RW, a DVD+RW, a magnetic tape, a nonvolatile memory card, a ROM or the like may also be used. The program code may alternatively be downloaded via a network.

The above-described functions of the embodiments are realized by executing the program code read out by the computer. The present invention also comprises other arrangements, e.g., one in which an operating system (OS) or the like operating on the computer performs a part or the whole of actual processing on the basis of instructions according to the program code to perform the above-described functions of the embodiments.

The present invention also comprises an arrangement in which the program code read out from the storage medium is written to a memory provided on a function expansion board inserted in the computer or a function expansion unit connected to the computer, and in which a CPU or the like provided in the function expansion board or the function expansion unit performs part or the whole of actual processing on the basis of instructions according to the program code to perform the above-described functions of the embodiments.

The functions of each of the above-described embodiments are realized by the computer executing the program code read out. Needless to say, the present invention also comprises an arrangement in which an OS or the like operating on the computer performs part or the whole of actual processing on the basis of instruction according to the program code to realize the above-described functions of each embodiment.

In such a case, the program is supplied by being directly read out from the storage medium on which the program is stored or being downloaded from another computer, a database or the like (not shown) connected to the Internet, a commercial network, a local area network or the like.

While the embodiments have been described with respect to a case where the printing system of the image forming apparatus is an electrophotographic system. However, the present invention is not limited to the electrophotographic system. The present invention can be applied to various printing systems, e.g., an ink jet system, a thermal transfer system, a heat sensing system, an electrostatic system and a discharge breakdown system.

The form of the above-described program may comprise an object code, a program code executed by an interpreter, scrip data supplied to an operating system (OS), or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-259495, filed Sep. 25, 2006 which is hereby incorporated by reference herein in its entirety.

What is claimed is:

1. An image forming apparatus comprising:

conversion unit adapted to perform data conversion of image data;

image forming unit adapted to form an image based on the converted image data;

fixing unit adapted to fix the image formed by said image forming unit;

detection unit adapted to detect a temperature of said fixing unit;

measurement unit adapted to measure an optical characteristic of a patch image fixed by said fixing unit using different fixing temperatures;

preparation unit adapted to prepare said data conversion tables each corresponding to the temperature detected by said detection unit, by using the measured optical characteristic of the patch image; and storage unit adapted to store the data conversion tables prepared by said preparation unit;

wherein said conversion unit changes data conversion tables used at the data conversion in correspondence with the detected temperature.

2. The image forming apparatus according to claim 1, wherein measurement of the optical characteristic of the patch image by said measurement unit is executed at a startup time.

3. The image forming apparatus according to claim 1, further comprising:

operation history storage unit adapted to store an operation history of said image forming apparatus; and first control unit adapted to perform control based on the operation history as to whether or not the optical characteristic of the patch image is to be measured by said measurement unit.

4. The image forming apparatus according to claim 1, further comprising:

time lapse history storage unit adapted to store a time lapse history of said image forming apparatus; and first control unit adapted to perform control based on the time lapse history as to whether or not the optical characteristic of the patch image is to be measured by said measurement unit.

5. The image forming apparatus according to claim 1, further comprising instruction unit adapted to instruct to execute measurement of the optical characteristic of the patch image by said measurement unit.

* * * * *